US010366710B2

(12) United States Patent
Ryou et al.

(10) Patent No.: US 10,366,710 B2
(45) Date of Patent: Jul. 30, 2019

(54) ACOUSTIC MEANINGFUL SIGNAL DETECTION IN WIND NOISE

(71) Applicant: NXP B.V., Eindhoven (NL)

(72) Inventors: Jungryul Ryou, Los Gatos, CA (US); Lei Yin, Santa Clara, CA (US)

(73) Assignee: NXP B.V., Eindhoven (NL)

( * ) Notice: Subject to any disclaimer, the term of this patent is extended or adjusted under 35 U.S.C. 154(b) by 113 days.

(21) Appl. No.: 15/619,189

(22) Filed: Jun. 9, 2017

(65) Prior Publication Data

US 2018/0358036 A1 Dec. 13, 2018

(51) Int. Cl.

| | |
|---|---|
| ***G10L 25/84*** | (2013.01) |
| ***G10L 21/0232*** | (2013.01) |
| ***G10L 21/0224*** | (2013.01) |
| ***G10L 25/21*** | (2013.01) |

(52) U.S. Cl.

CPC ..... *G10L 25/84* (2013.01); *G10L 21/0224* (2013.01); *G10L 21/0232* (2013.01); *G10L 25/21* (2013.01)

(58) Field of Classification Search

CPC combination set(s) only.
See application file for complete search history.

(56) References Cited

U.S. PATENT DOCUMENTS

2008/0234945 A1* 9/2008 Walk ..... G01N 30/8668 702/19
2014/0073941 A1* 3/2014 Rodriguez-Llorente ..... A61B 5/7207 600/476
2015/0058002 A1* 2/2015 Yermeche ..... G10L 25/84 704/233

(Continued)

FOREIGN PATENT DOCUMENTS

EP 1450354 A1 8/2004
WO WO-2012/109019 A1 8/2012

(Continued)

OTHER PUBLICATIONS

Nelke, Christoph et al; "Wind Noise Detection: Signal Processing Concepts for Speech Communication"; DAGA 2016 Aachen; retrieved from the internet http://ikspub.iks.rwth-aachen.de/pdfs/nelke16.pdf ; 4 pages (2016).

(Continued)

*Primary Examiner* — Shreyans A Patel

(57) ABSTRACT

A method of distinguishing a meaningful signal from a low frequency noise, such method includes:

a first step of dividing an input acoustic signal into frames, a second step of calculating a power spectral density of the input acoustic signal for each frame and finding an envelope curve of the power spectral density, a third step of finding a predefined number of dominant peaks in the envelope curve found in the previous second step of the method, a fourth step of applying a linear regression algorithm to the dominant peaks to obtain a linear regression line for each frame and extracting a slope value of each linear regression line, a fifth step of identifying intervals ($t_1$-$t_2$, $t_3$-$t_4$) of the original acoustic signals including the meaningful signal as intervals which correspond to higher values of the slope value.

11 Claims, 3 Drawing Sheets

(56) References Cited

U.S. PATENT DOCUMENTS

2015/0139445 A1 5/2015 Kitazawa

FOREIGN PATENT DOCUMENTS

WO WO-2013/164029 A1 11/2013
WO WO-2016/011499 A1 1/2016

OTHER PUBLICATIONS

Nelke, Christoph Matthias et al; "Single Microphone Wind Noise PSD Estimation Using Signal Centroids"; IEEE ISASSP, Florence, Italy; 5 pages (May 2014).
Nemer, Elias et al; "Single-Microphone Wind Noise Reduction by Adaptive Postfilerting"; IEEE Workshop on Applications of Signal Processing to Audio and Acoustics, New Paltz, NY, US; 4 pages (Oct. 18-21, 2009).

* cited by examiner

ACOUSTIC MEANINGFUL SIGNAL DETECTION IN WIND NOISE

FIELD OF THE INVENTION

The present invention relates to a method of distinguishing meaningful signal, such as speech, from wind noise.

In the proliferation of smart devices, wearables, action cameras, and "IoT" (Internet of Things) devices, the microphones on those devices are prone to be badly affected by wind noise. In an effort to suppress wind noise, several methods were developed. The main problem that these method faces is that wind noise reduction suppresses the meaningful signal also. In that context, such methods require procedures to effectively distinguish the signal from wind noise and preserve more meaningful signal while suppressing wind noise as much as possible. The results of the existing methods provide poor speech quality after wind reduction especially for high wind intensity and in case a single microphone is being used.

In particular, previous solution investigated that wind noise mostly has power in low frequency area, and inside an algorithm for wind noise reduction, it estimates this wind noise power spectrum frame by frame and subtracts this estimated power spectrum from the power spectrum of mixed signal (speech+wind noise) with some additional processing.

For the signal segments where both speech and wind noise exist, subtracting estimated wind noise from mixed signal result in the suppression of speech also, which is not desirable. In that sense, an algorithm needs to apply the relaxation on this processing where both speech and wind noise present to preserve important signal while suppressing wind noise. To do that, an algorithm needs to detect frames which have speech or important signal and needs to apply the relaxation on them as described above.

To detect those segments, prior works tried some features such as auto-correlation, cross-correlation, and so on, but those features are not showing very good performance especially in high wind intensity and single microphone use case.

It is therefore still desirable to provide a method, which overcome the above problems by applying new signal detection from wind noise, thus improving the performance of wind noise reduction

SUMMARY

This need may be met by the subject matter according to the independent claim. Advantageous embodiments of the present invention are described by the dependent claims.

According to the invention a method of distinguishing a meaningful signal from a low frequency noise includes:

a first step of dividing an input acoustic signal into frames, a second step of calculating a power spectral density of the input acoustic signal for each frame and finding an envelope curve of the power spectral density, a third step of finding a predefined number of dominant peaks in the envelope curve found in the previous second step of the method, a fourth step of applying a linear regression algorithm to the dominant peaks to obtain a linear regression line for each frame and extracting a slope value of each linear regression line, a fifth step of identifying intervals of the original acoustic signals including the meaningful signal as intervals which correspond to higher values of the slope value.

In particular, according to a possible embodiment of the present invention, the low frequency noise is wind noise and the meaningful signal is human voice.

Optionally in the fourth step slope values may be adaptively smoothed over frames, so that slope values do not fluctuate too much.

With "adaptively smoothed" it is meant higher smoothing for possible wind noise frames and lower smoothing for the others based on the low frequency energy calculated, since most of fluctuations happened in the wind noise frames and these fluctuations can cause degraded speech quality.

Further optionally the method may include a sixth step of adaptively applying a suppression algorithm to the intervals identified in the fifth step to suppress low frequency noise and preserve the meaningful signal. Advantageously, according to the present invention, the suppression algorithm may be applied only to the intervals of the input acoustic signal which do not include the meaningful signal. A lower signal suppression or no signal suppression on the frames which have meaningful signal helps preserve more meaningful signal, e.g., speech.

According to exemplary embodiments of the present invention in the fifth step one a low slope threshold value and one high slope threshold value are defined for the plurality of slope values. Accordingly, intervals of the original acoustic signals including the meaningful signal can be identified as those intervals where slope values exceed the high slope threshold value.

According to a possible exemplary embodiment of the present invention, in the fifth step of the method a sigmoid function is applied to the slope values and to the slope threshold values. Accordingly, intervals of the original acoustic signals including the meaningful signal can be automatically identified as the intervals where the value of the sigmoid function is '0'.

According to a second expect of the present invention, an electronic device includes a computer readable storage medium having computer program instructions in the computer readable storage medium for enabling a computer processor to execute the method according to any of the previous claims. Such electronic may be any electronic device including a microphone.

According to exemplary embodiments of the present invention, such electronic device is a smartphone or a wearable or a hearable or an action cam or any so called "IoT" (Internet of Things) device.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DESCRIPTION OF EMBODIMENTS

Figure 1:
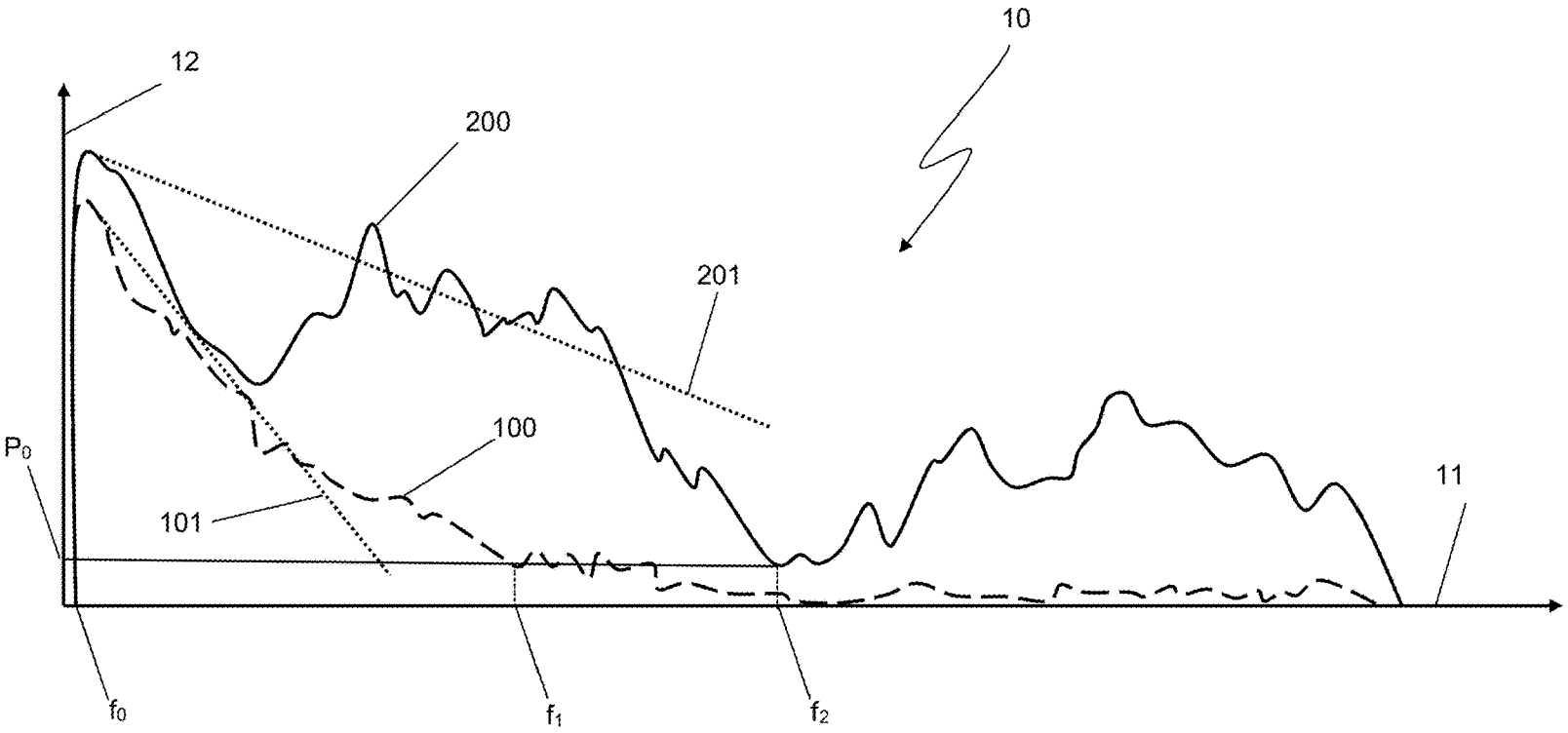
FIG. 1 shows a power spectrum for both a wind-only signal and a signal including wind and speech.

FIG. 1 is a graph 10 shows a power spectrum for both a first wind signal 100 and a second signal 200 including wind and speech. In the graph 10 the Cartesian ordinate axis 11 and coordinate axis 12 respectively represent frequency and power.

Typically wind noise 100 has a power greater than a significant predefined power threshold P0 between an initial frequency f0 and a first threshold frequency f1. For frequencies greater than f1 the wind noise 100 can be neglected, particularly with respect to the second signal 200 including wind and speech. In the interval of frequencies f0-f1 the wind signal 100 can be well represented by a first straight line 101 having a negative slope in the graph 10.

The second signal 200 including wind and speech has a power greater than a significant predefined threshold, in particular a power threshold coincident to P0, between the initial frequency f0 and a second threshold frequency f2, greater than the first threshold frequency f1. In particular, the interval of frequencies f0-f2 extends in mid and high frequency areas. In the interval of frequencies f0-f2 the second signal 200 including wind and speech can be well represented by a second straight line 201 having a negative slope in the graph 10. The slope of the second straight line 201 is typically greater than the slope of the first straight line 101, i.e. the first straight line 101 has a steeper slope than the second straight line 201.

According to the method of the present invention, the slopes of the first straight line 101 and of the second straight line 201 can be calculated as follows.

In a first step of the method, an acoustic input signal is divided into frames, e.g., 10 ms frames. The acoustic signal may be previously registered or the analysis may be performed online, while detecting the signal. Acoustic signal may be particularly buffered to divide in frames, e.g., 10 ms frames, for processing.

In a second step of the method the power spectral density of each frame is calculate and a maximum envelope curve of the power spectral densities is found.

In a third step of the method, a predefined number of dominant peaks in the envelope are found, so that small peaks in deep valley (e.g., between wind noise and speech part) of the envelope would not affect the following forth step of the method.

In a fourth step of the method, the linear regression algorithm is applied to the dominant peaks obtained in the previous third step to obtain a linear regression line for each frame, and slope value of the linear regression line is extracted. The slope may correspond to the slope of a steeper linear regression line (like the first straight line 101 of FIG. 1) or to a less steep linear regression line (like the second straight line 201 of FIG. 1). Optionally, the slope values may be adaptively smoothed over frames, so that slope values do not fluctuate too much without in any case prejudice to the execution of the next step of the method.

In a fifth final step of the method, intervals of the original acoustic signals, which corresponds to speech only or to wind noise and speech, are identified as the intervals which correspond to higher values of the slope values calculated in the previous step of the method.

Figure 2:
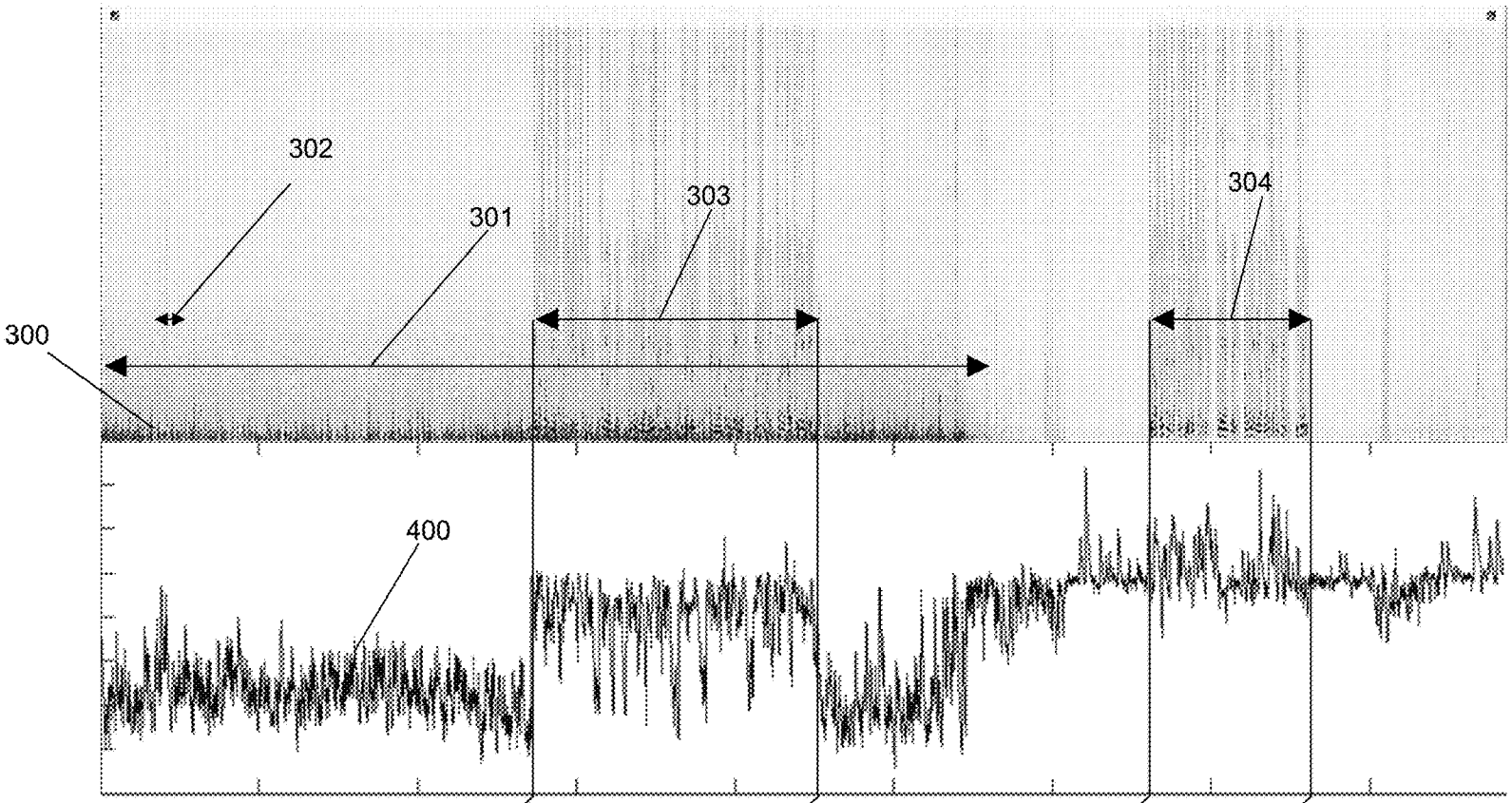
FIG. 2 shows a slope feature calculated according to the method of the present invention for a signal including wind and speech.

An example of the application of the above method is shown in FIG. 2.

In FIG. 2 an acoustic input signal 300 includes a first noise interval 301 where wind noise is present. The power spectrum of the acoustic input signal 300 is represented in FIG. 2 as a function of time. The first noise interval 301 includes a first noise sub-interval 302, where in addition to wind noise also a door noise is present, and a subsequent second noise sub-interval 303, where in addition to wind noise also voice is present. The acoustic signal 300 includes a second noise interval 304, distanced from the first noise interval 301, where only voice is present.

The present invention can be applied more in general to any type of acoustic input signal including wind, or other similar disturbances low frequency noise, and a meaningful signal.

By applying the first, second, third and fourth steps of the method of the present invention, as above described, the plurality of slope values 400, one for each frame in which the acoustic input signal 300 is divided, are calculated and represented below the acoustic input signal 300. By applying the fifth step of the method of the present invention, time values t1, t2, t3 and t4 are identified, corresponding to respective steps in the sequence of the slope values 400. Between the time interval t1-t2 and t3-t4 slope values 400 are higher than in the rest of the time domain. Such time intervals are, accordingly to the present invention, identified as time intervals of the original acoustic input signal 300, which corresponds to speech only or to wind noise and speech, i.e. to the second noise sub-interval 303 and the second noise interval 302.

Figure 3:
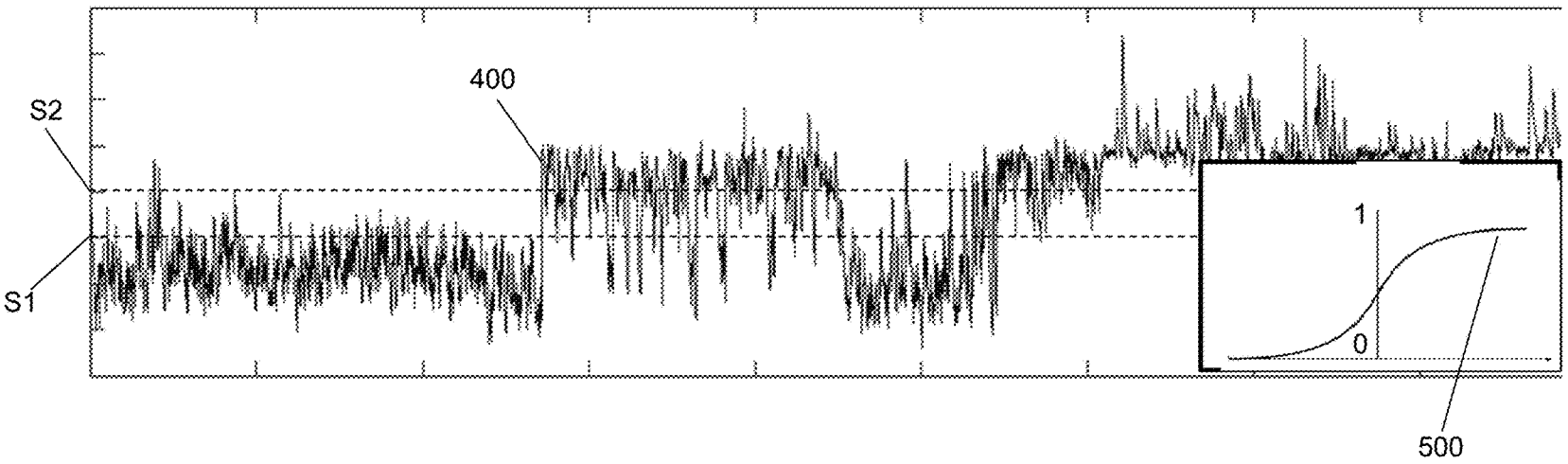
FIG. 3 shows a sigmoid function applied to the calculated slope feature with thresholds values.

An automatic procedure to apply the fifth step of the method of the present invention can be implemented as illustrated in FIG. 3. As depicted in FIG. 3, one low slope threshold value S1 and one high slope threshold value S2 are defined for the plurality of slope values 400. A sigmoid function 500 is subsequently applied to the slope values 400 with the slope threshold values S1, S2 to create two flags, 0-1, corresponding to respective values of the sigmoid function, for the plurality of slope values 400. Flag '1' means wind noise, i.e. slope values are below the low slope threshold value S1, flag '0' means there is speech or meaningful signal, i.e. slope values are above the high slope threshold value S2.

Once time intervals where speech is present are identified, like for example the time intervals t1-t2 and t3-t4 of the example of FIGS. 2 and 3, through the analysis of the slope values 400 and/or of the slope flag, wind noise suppression algorithm can be adaptively applied to such intervals to preserve more speech signal while suppressing wind noise and improve speech user interfaces performance in windy situation. Any suppression algorithm may be used during this step of the method.

The present invention can be integrated in electronic devices including a microphone, for example in smartphones, wearables, hearables, action cams, and in any so called "IoT" (Internet of Things) devices which have a microphone. In such electronic device, a computer readable storage medium may be provided having computer program instructions for enabling a computer processor in the electronic device to execute the method according to the present invention.

REFERENCE NUMERALS

10 graph
11, 12 ordinate axis, coordinate axis,
100 first wind signal,
200 second wind and speech signal,
101 straight line approximating wind signal,
201 straight line approximating wind and speech signal,
P0 power threshold,
$f_0$, $f_1$, $f_2$ frequencies
300 acoustic input signal,
301 first noise interval,
302 first noise sub-interval,
303 second noise sub-interval,

304 second noise interval,
400 slope values,
$t_1$, $t_2$, $t_3$, $t_4$ time vaues
500 sigmoid function
S1, S2 slope threshold values

The invention claimed is:

1. A method of distinguishing, within a received acoustic signal, a meaningful acoustic signal from low frequency acoustic noise, comprising:

a first step of dividing the acoustic signal into frames, a second step of calculating a power spectral density of the acoustic signal for each frame and finding an envelope curve of the power spectral densities, a third step of finding a predefined number of dominant peaks in the envelope curve, a fourth step of applying a linear regression algorithm to the dominant peaks to obtain a linear regression line for each frame of the acoustic signal and extracting a slope value of each linear regression line, a fifth step of defining those intervals within the acoustic signal that include the meaningful signal as intervals which correspond to higher values of the slope value.

2. The method according to claim 1, wherein in the fourth step slope values are adaptively smoothed over frames.

3. The method according to claim 1, wherein in the fifth step one low slope threshold value or one high slope threshold value are defined for the plurality of slope values.

4. The method according to claim 3, wherein in the fifth step a sigmoid function is applied to the slope values and to the slope threshold values.

5. The method according to claim 1, wherein in the first step the acoustic signal is divided into frames of 5 to 100 ms.

6. The method according to claim 1, further including a sixth step of adaptively applying a suppression algorithm to the intervals identified in the fifth step to suppress low frequency noise and preserve the meaningful signal.

7. The method according to claim 1:

wherein the low frequency acoustic noise is wind noise.

8. The method according to claim 1:

wherein the meaningful acoustic signal is a speech signal.

9. An electronic device for distinguishing, within a received acoustic signal, a meaningful acoustic signal from low frequency acoustic noise, comprising:

an input for receiving an acoustic signal; and a processor configured to, divide the acoustic signal into frames;

calculate a power spectral density of the acoustic signal for each frame;

find an envelope curve of the power spectral densities;

find a predefined number of dominant peaks in the envelope curve;

apply a linear regression algorithm to the dominant peaks to obtain a linear regression line for each frame of the acoustic signal;

extract a slope value of each linear regression line; and define those intervals within the acoustic signal that include the meaningful signal as intervals which correspond to higher values of the slope value.

10. The electronic device of claim 9:

wherein the electronic device is configured to receive the acoustic signal from a microphone.

11. The electronic device of claim 10:

wherein the electronic device further comprising the microphone.

* * * * *